US006359229B1

(12) United States Patent
Larson et al.

(10) Patent No.: US 6,359,229 B1
(45) Date of Patent: Mar. 19, 2002

(54) POWER LINE FUSE BYPASS

(76) Inventors: George J. Larson, 1417 Broadway, Helena, MT (US) 59601; Patrick S. Glueckert, 1505 Lexington Rd.; John Czapranski, 5561 Canyon Ct., both of Helena, MT (US) 59602

( * ) Notice: Subject to any disclaimer, the term of this patent is extended or adjusted under 35 U.S.C. 154(b) by 0 days.

(21) Appl. No.: 09/578,372

(22) Filed: May 25, 2000

Related U.S. Application Data

(60) Provisional application No. 60/135,974, filed on May 26, 1999.

(51) Int. Cl.[7] ..... H01B 7/18; H01B 17/24

(52) U.S. Cl. ..... 174/102 R; 174/208

(58) Field of Search ..... 174/102 R, 36, 174/208, 108

(56) References Cited

U.S. PATENT DOCUMENTS 2,287,499 A * 6/1942 Smith, Jr. ..... 200/114
2,347,851 A * 5/1944 Steinmayer et al. ..... 200/114
2,689,944 A * 9/1954 Curtis ..... 339/9
2,728,055 A 12/1955 Curtis
2,728,056 A 12/1955 deMontmollin
2,734,965 A * 2/1956 Wood ..... 200/114
3,032,630 A * 5/1962 McCloud et al. ..... 200/114
3,212,046 A 10/1965 Abel et al.
3,774,137 A * 11/1973 Carothers ..... 337/174
3,907,391 A 9/1975 Emery et al.
4,321,575 A * 3/1982 Koszewa et al. ..... 337/168
5,300,912 A * 4/1994 Tillery et al. ..... 337/180
5,427,546 A 6/1995 Garritano et al.

* cited by examiner

*Primary Examiner*—Dean A. Reichard
*Assistant Examiner*—William H. Mayo, III
(74) *Attorney, Agent, or Firm*—Richard C. Conover

(57) ABSTRACT

A power line fuse bypass having a first terminal for connecting to a first contact on one side of an electrical transmission line fuse, and a second terminal for connecting to a second contact on the opposite side of said fuse. An electrically conductive wire is provided for electrically connecting the first terminal to the second terminal. A coil spring is provided in surrounding relation to the wire with one end of the coil spring connected to the first terminal, and the second end of the coil spring connected to the second terminal.

5 Claims, 4 Drawing Sheets

POWER LINE FUSE BYPASS

Applicants claim the benefit under 35 U.S.C. §119(e) of the provisional application, Ser. No. 60/135,974, which was filed May 26, 1999, now expired.

BACKGROUND OF INVENTION

1. Field of the Invention

The present invention relates to power line equipment, and more specifically to equipment used to bypass a working power line fuse when a fuse is being inspected or changed.

Fuse devices are used in electrical transmission lines to protect the transmission lines from current overloads. When fuses need to be checked or changed, a hot line jumper or mack is conventionally used to direct current around the fuse. When this is done, the fuse can then be removed for inspection or replacement. Hot line jumpers are usually attached to the line by means of a hot stick, or a person wearing rubber gloves. This method can be very hazardous, especially when working around junction poles or where the transmission line goes underground. It also requires the use of a bucket truck and several men. The proximity of the workers to the high voltage line is in itself dangerous.

2. Description of the Related Art

To solve this problem, several jumpering devices have been developed in the prior art. Examples of these jumpering devices would include: U.S. Pat. No. 2,287,499 to Smith, Jr; U.S. Pat. No. 2,347,851 to Steinmayor, et al.; U.S. Pat. No. 2,689,944 to Curtis; U.S. Pat. No. 2,728,056 to Montmollin; U.S. Pat. No. 2,734,965 to Wood; and U.S. Pat. No. 3,032, 630 to McCloud, et al. All of these prior art jumpering devices, however, suffer from the disadvantage that they are not capable of being bent in a transverse direction and therefore are difficult to connect between the appropriate contact points to allow the re-fusing operation.

The present invention overcomes this disadvantage by providing a flexible power line fuse bypass device which is easily connected to the electrical contacts on either side of the fuse to bypass the fuse. This tool provides a person to be able to stay at a safe distance and also eliminates the risk of having a phase-to-phase fault which could prove catastrophic.

SUMMARY OF INVENTION

The present invention relates to a power line fuse bypass having a first terminal for connecting to a first contact on one side of an electrical transmission line fuse, and a second terminal for connecting to a second contact on the opposite side of said fuse. An electrically conductive wire is provided for electrically connecting the first terminal to the second terminal. A coil spring is provided in surrounding relation to the wire with one end of the coil spring connected to the first terminal, and the second end of the coil spring connected to the second terminal.

DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF PREFERRED EMBODIMENTS

Figure 2:
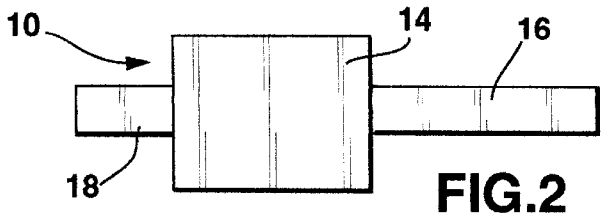
FIG. 2 is a top plan view of the fuse bypass shown in FIG. 1.
Figure 1:
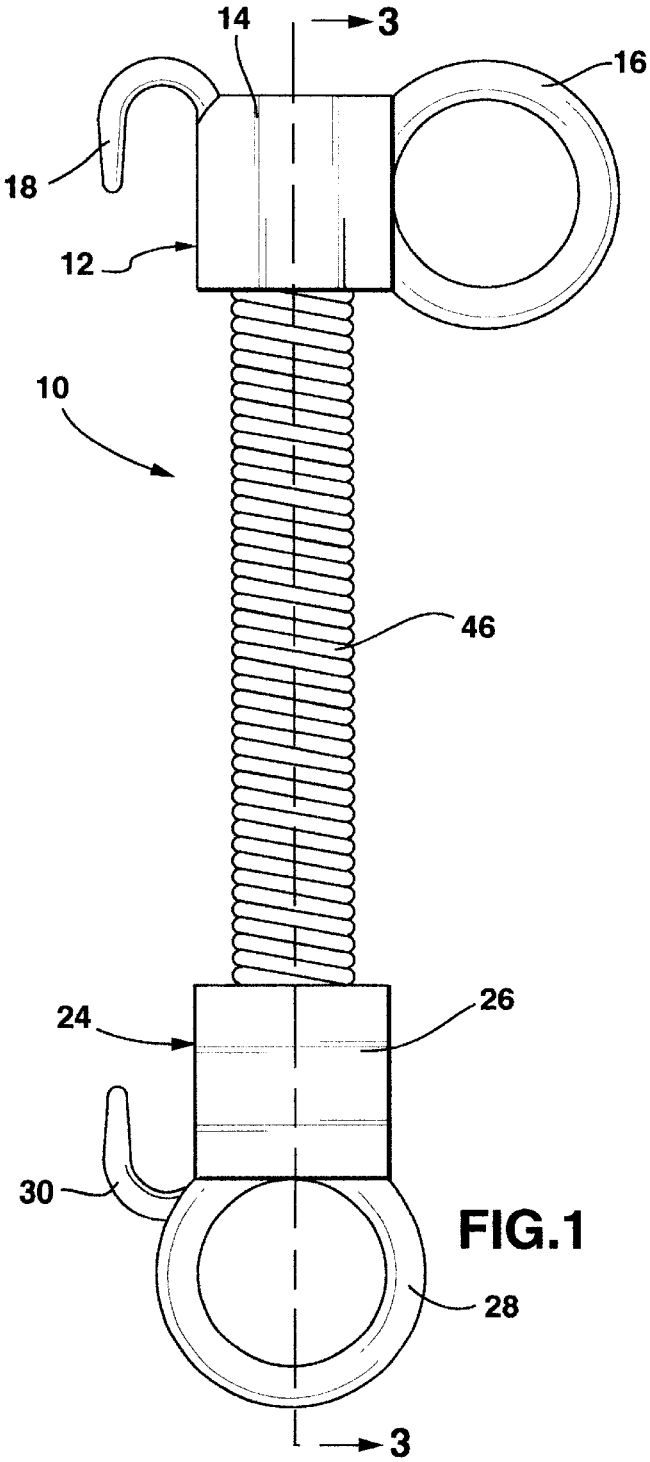
FIG. 1 is an elevational view of a power line fuse bypass according to the present invention.
Figure 3:
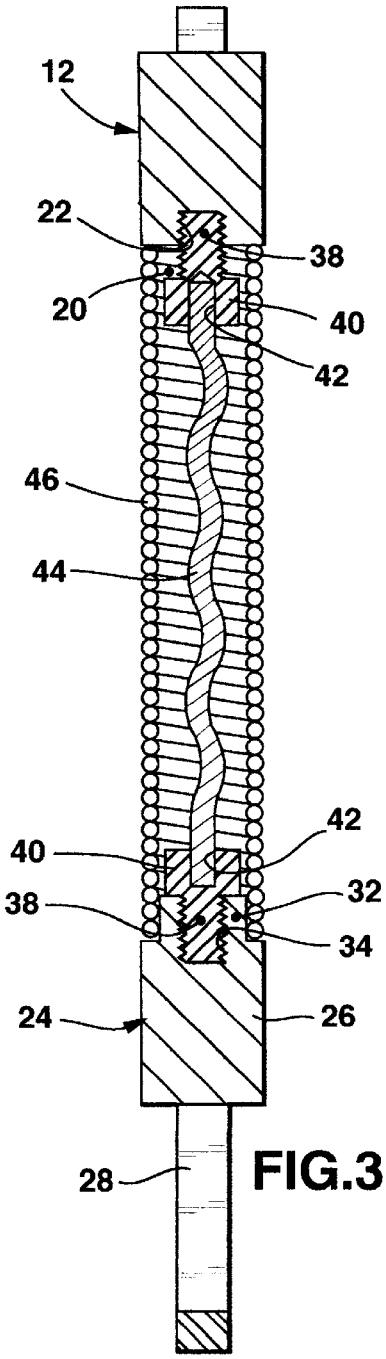
FIG. 3 is a cross-sectional view taken along the line 3—3 in FIG. 1.
Figure 8:
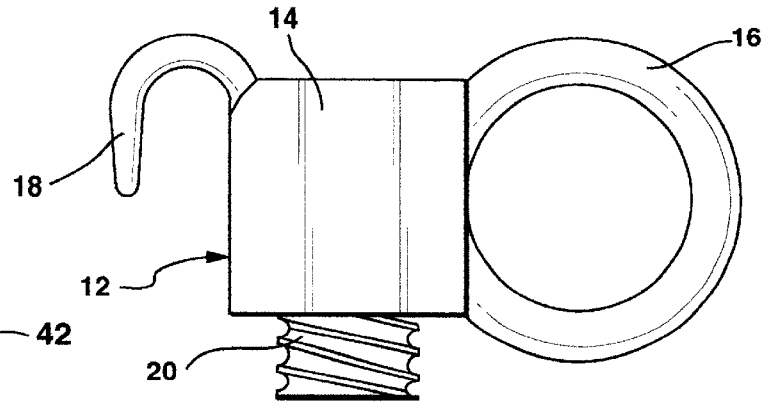
FIG. 8 is a detail elevational view of a first terminal shown in FIG. 1.
Figure 9:
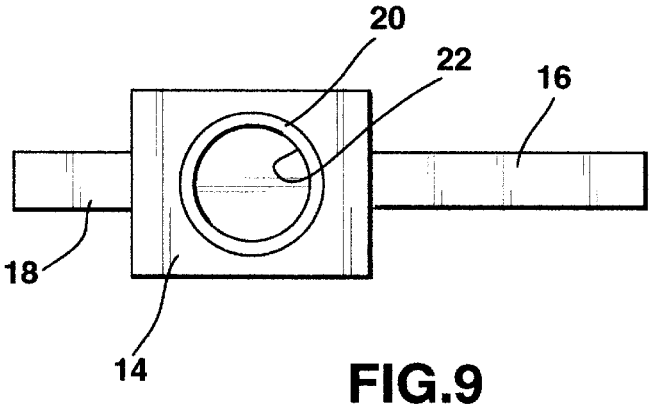
FIG. 9 is a bottom plan view of the first terminal shown in FIG. 8.
Figure 6:
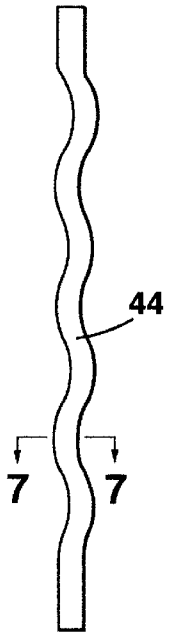
FIG. 6 is a detail elevational view of a wire shown in FIG. 3.
Figure 7:
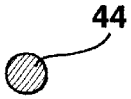
FIG. 7 is a cross-sectional view taken along the line 7—7 in FIG. 6.

A power line fuse bypass 10 is shown in FIG. 1. Bypass 10 includes a first terminal 12, formed from an electrically conductive metal. Terminal 12 includes a body 14, ring 16, and hook 18. Ring 16 and hook 18 are formed integral with body 14, as shown in FIGS. 1–2. As best seen in FIGS. 3 and 8, body 14 further includes a depending cylindrical boss 20 having external threads. A hole 22 is bored through boss 20 and into body 14 as shown in FIG. 9. This hole 22 is provided with internal threads.

A second terminal 24 is positioned at an end of fuse bypass 10, opposite terminal 12. Terminal 24 includes body 26, a ring 28, and a hook 30, formed integral with the body. Body 26 also includes a cylindrical boss 32 having external threads and a hole 34 with internal threads. Boss 32 is sized to be the same as boss 20 and hole 34 is sized to be the same as hole 22.

Figure 4:
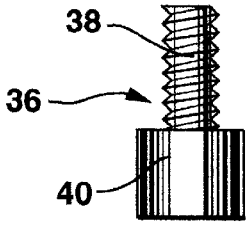
FIG. 4 is a detail elevational view of a wire-holder shown in FIG. 3.
Figure 5:
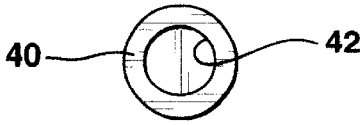
FIG. 5 is a bottom plan view of the wire-holder shown in FIG. 4.

A swage assembly 36 is threadably connected to first terminal 12 and second terminal 24 as shown in FIG. 3. As shown in FIG. 4, each swage assembly 36 includes a body 40 with a threaded stem 38 at one end. Body 40 is constructed of a material which may be crimped. A hole 42, best seen in FIG. 5, is drilled into body 40. Threaded stems 38 are threadably received by holes 22 and 34.

A wire 44 is used to electrically connect the first terminal 12 to second terminal 24. Each end of wire 44 is inserted into a hole 42 of a respective swage assembly 36. The bodies 40 are then crimped to fixedly hold wire 44 in holes 42. In place, as shown in FIG. 3, wire 44 is compressed in length as shown to allow the wire 44 to be stretched in length if necessary.

A coil spring 46 is positioned in surrounding relationship to wire 44. The spring 46 is sized to have an internal diameter so that an end of spring 46 can be threaded on cylindrical boss 20 and cylindrical boss 32.

Figure 10:
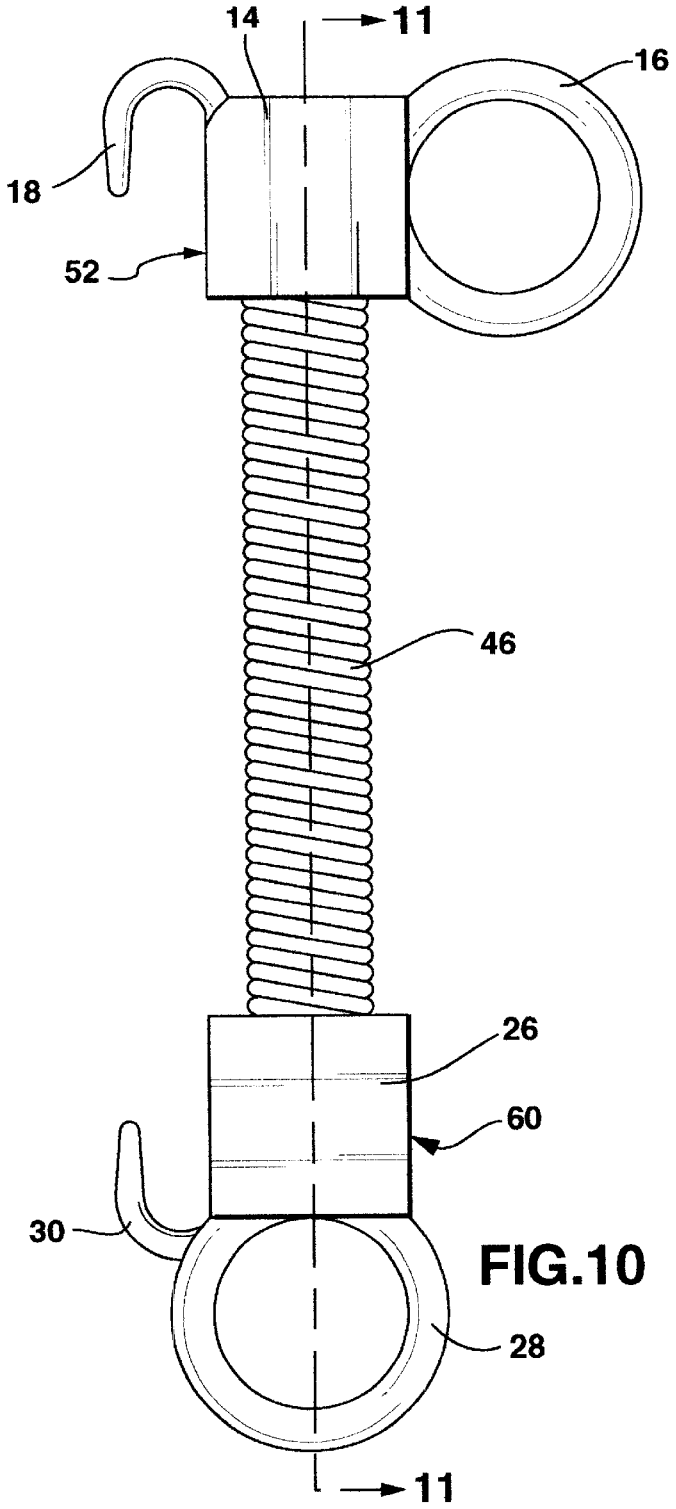
FIG. 10 is an elevational view of a power line fuse bypass according to a second embodiment of the present invention.
Figure 11:
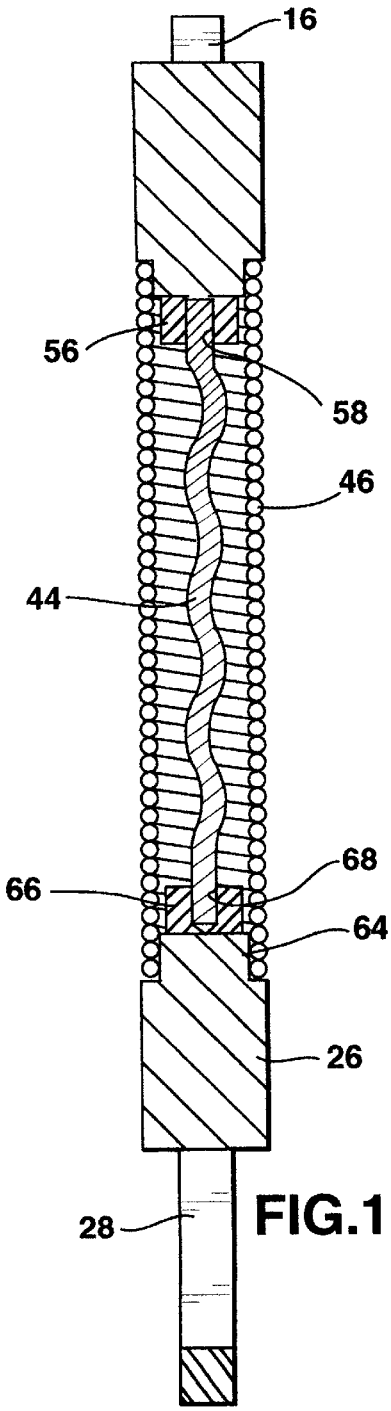
FIG. 11 is a detail elevational view of a first terminal shown in FIG. 10 according to a second embodiment of the present invention.
Figure 12:
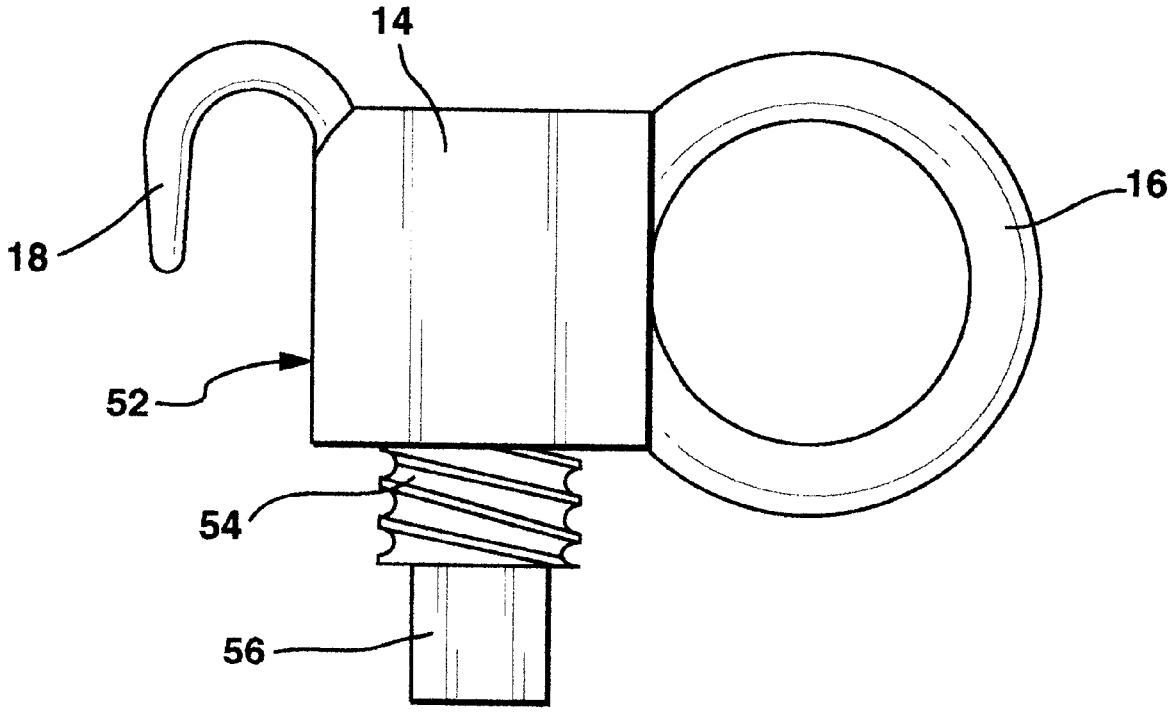
FIG. 12 is a cross-sectional view taken along the line 12—12 in FIG. 10.

A second embodiment of the present invention is shown in FIGS. 10–12. A power line fuse bypass 50 is shown having a terminal 52 corresponding with terminal 12 as shown in FIG. 8. Terminal 52 includes a body 14, ring 16, and a hook 18 corresponding with the elements of terminal 12 as shown in FIG. 11. The terminal 52 further includes a depending cylindrical boss 54 having external threads. A swage assembly 56 is formed in depending relation to boss 54 as shown in FIG. 12. The swage assembly 56 is provided with a hole 58, as shown in FIG. 11, which is bored into swage assembly 56. The hole 58 is sized to receive the wire 44. Once wire 44 is inserted into hole 58, the swage assembly is swaged onto wire 44.

A second terminal 60 is positioned at an end of fuse bypass 50, opposite terminal 52. Terminal 62 corresponds with terminal 24 as shown in FIG. 1. Terminal 62 includes body 26, a ring 28 and hook 30 corresponding with the elements of terminal 24 as shown in FIG. 10. The terminal 62 further includes a depending cylindrical boss 64 having external threads. A swage assembly 66 is formed in depending relation to boss 64 as shown in FIG. 11. The swage assembly 66 is provided with a hole 68 which is bored into swage assembly 66. The boss 64 and swage assembly 66 are similar in shape to boss 54 and swage assembly 56 shown in FIG. 12. The hole 68 is sized to receive the wire 44. Once wire 44 is inserted into hole 68, the swage assembly is swaged onto wire 44.

The second embodiment shown in FIGS. 10–12 includes the same coil spring 46 and wire 44 as shown in FIGS. 1 and 3.

In operation, whenever a working fuse needs to be replaced, fuse bypass 10 or 50 can be used to place a current path in parallel with the fuse. Since a working fuse is normally placed in series in one line of a power line, the voltage drop across a good fuse is minimal. This means essentially the same voltage can be measured at both ends of the fuse. When a fuse is to be checked or replaced, an insulated pole can be used by a lineman on the ground lofting bypass 10 or 50 with ring 28 to place hook 30 on metal parts associated with one end of a working fuse. Then the insulated pole is used with ring 16 to stretch bypass 10 or 50 to a position where hook 18 can engage metal parts associated with the opposite end of the working fuse. Spring 46 and wire 44 accommodate this stretching. The minimal voltage drop across the working fuse means there will be very little, if any, sparking when bypass 10 or 50 is electrically connected across the fuse.

With fuse bypass 10 or 50 held securely in place by spring 44, current will continue to the customers below the fuse along a power line. The working fuse can then be disengaged and the fuse safely replaced. Once the new fuse is snapped into place in series in the power line, bypass 10 can be removed by using the insulated pole engaging ring 16 and, if necessary ring 28, to accomplish this task.

While the fundamental novel features of the invention have been shown and described, it should be understood that various substitutions, modifications, and variations may be made by those skilled in the art, without departing from the spirit or scope of the invention. Accordingly, all such modifications or variations are included in the scope of the invention as defined by the following claims:

We claim:

1. A power line bypass for bypassing a fuse connected between a first contact and a second contact comprising:

a first terminal including a hook means for making electrical contact with the first contact and a second terminal spaced apart from said first terminal and including a hook means for making electrical contact with the second contact;

electrically conductive wire electrically connecting the first terminal to the second terminal;

an elongate tension coil spring means positioned in surrounding relation to the wire with one end of the coil spring connected to the first terminal and a second end of the coil spring connected to the second terminal, for resiliently biasing the hook means of the first terminal toward the hook means of the second terminal; and the electrically conductive wire having a length greater than the longitudinal length of the coil spring at rest.

2. The power line bypass according to claim 1, wherein the first terminal includes a first engagement means for manipulating the first terminal to a position where the corresponding hook engages the first contact and wherein the second terminal includes a second engagement means for manipulating the second terminal to a position where the corresponding hook engages the second contact.

3. The power line bypass according to claim 2 wherein the first and second engagement means each comprises a ring attached to the first terminal and second terminal respectively.

4. A power line bypass for use with a fuse connected between a first contact and a second contact comprising:

a first terminal including a hook means for electrically connecting the bypass to the first contact;

a second terminal including a hook means spaced apart from the first terminal along a longitudinal axis for electrically connecting the bypass to the second contact;

an electrically conductive wire electrically connecting the first terminal to the second terminal;

an elongate tension resilient means which is flexible in a direction transverse the longitudinal axis and positioned in surrounding relation to the wire and having an end secured to the first terminal and an opposite end secured to the second terminal for resiliently biasing the hook means of the first terminal toward the hook means of the second terminal; and the electrically conductive wire having a length greater than the longitudinal length of the resilient means at rest.

5. The power line bypass according to claim 4 wherein the resilient means comprises a coil spring.

* * * * *